US006422690B1

(12) United States Patent
Harvey et al.

(10) Patent No.: US 6,422,690 B1
(45) Date of Patent: Jul. 23, 2002

(54) DROP ON DEMAND INK JET PRINTING APPARATUS, METHOD OF INK JET PRINTING, AND METHOD OF MANUFACTURING AN INK JET PRINTING APPARATUS

(75) Inventors: Robert A. Harvey; Stephen Temple, both of Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/475,816

(22) Filed: Dec. 30, 1999

Related U.S. Application Data

(63) Continuation of application No. PCT/GB98/01955, filed on Jul. 2, 1998.

(30) Foreign Application Priority Data

Jul. 2, 1997 (GB) ..... 9713872

(51) Int. Cl.[7] ..... B41J 2/045

(52) U.S. Cl. ..... 347/68
(58) Field of Search ..... 347/68–72

(56) References Cited

U.S. PATENT DOCUMENTS 3,747,120 A 7/1973 Stemme ..... 346/75
3,946,398 A 3/1976 Kyser et al. ..... 346/1

(List continued on next page.)

FOREIGN PATENT DOCUMENTS

DE 196 39 436 A1 4/1997
DE 196 39 717 A1 4/1997

(List continued on next page.)

OTHER PUBLICATIONS

"Ink on Demand Using Silicon Nozzles," IBM Technical Disclosure Bulletin, vol. 19, No. 6, Nov. 1976, pp. 2255–2256.
"Focusing Ink Jet Head," IBM Technical Disclosure Bulletin, vol. 16, No. 4, Sep. 1973, p. 1168.
International Search Report in PCT/GB98/01955 Dated Oct. 28, 1998.
International Preliminary Examination Report in PCT/GB98/01955 Dated Oct. 22, 1999.

*Primary Examiner*—John Barlow
*Assistant Examiner*—Ly T Tran
(74) *Attorney, Agent, or Firm*—Marshall, Gerstein & Borun

(57) ABSTRACT

A droplet on demand inkjet apparatus utilizing a piezoelectric actuator arranged so as to deflect in shear mode, a method of ink jet printing, and a method of manufacturing an ink jet printing apparatus are disclosed. The apparatus is formed of a plurality of laminated plates arranged so as to define an ink chamber. The actuator forms one side of the chamber and deflects towards a nozzle formed in a nozzle plate which provides the opposite side of the chamber. An interconnect layer acts as the substrate and has orifices to allow the tracks to the drive chip to pass through. On the opposite side of the interconnect layer is the piezoelectric sheet. Electrodes are provided between the interconnect layer and the piezoelectric sheet. The piezoelectric sheet is carved, drilled or molded so as to provide parallel ink channels and a circular depression with a raised central reservation. The piezoelectric sheet is bonded to the interposer plate or ground electrode which in turn is bonded to the nozzle plate. When a charge is applied between the two electrodes, a selected actuator of the piezoelectric sheet deflects in shear mode towards the nozzle plate. This movement provides sufficient energy to eject a droplet from the nozzle. A number of short pulses could be applied so as to increase the size of the droplet ejected. A number of distinct pressure chambers connected only by the parallel ink channels are arranged in a two dimensional matrix which allows for increased distances between the actuators allowing for less densely packed electrical connection than are required in a linear array.

96 Claims, 8 Drawing Sheets

U.S. PATENT DOCUMENTS

| | | | | |
|---|---|---|---|---|
| 3,988,745 | A | 10/1976 | Sultan | 346/140 R |
| 4,312,010 | A | 1/1982 | Döring | 346/140 R |
| 4,353,078 | A | 10/1982 | Lee et al. | 346/140 R |
| 4,383,264 | A | 5/1983 | Lewis | 346/140 R |
| 4,599,628 | A | 7/1986 | Doring et al. | 346/140 R |
| 4,825,227 | A | 4/1989 | Fischbeck et al. | 346/1.1 |
| 4,937,597 | A | 6/1990 | Yasuhara et al. | 346/140 R |
| 5,719,604 | A | 2/1998 | Inui et al. | 347/54 |
| 5,757,400 | A | 5/1998 | Hoisington | 347/40 |
| 5,828,394 | A | * 10/1998 | Khuri-Yakub et al. | 347/68 |

FOREIGN PATENT DOCUMENTS

| | | | |
|---|---|---|---|
| EP | 0 336 043 | | 10/1989 |
| EP | 0 339 528 | | 11/1989 |
| EP | 0 426 473 | A2 | 5/1991 |
| JP | 57 133081 | A | 8/1982 |
| JP | 58 168573 | A | 10/1983 |
| WO | WO 88/07935 | A | 10/1988 |
| WO | WO 88/10192 | A | 12/1988 |
| WO | WO 97/28000 | A | 8/1997 |

* cited by examiner

DROP ON DEMAND INK JET PRINTING APPARATUS, METHOD OF INK JET PRINTING, AND METHOD OF MANUFACTURING AN INK JET PRINTING APPARATUS

This application is a continuation of PCT/GB 98/01955 filed Jul. 2, 1998.

This invention relates to drop on demand ink jet printing apparatus and, in one example, to drop on demand ink jet printing apparatus having a two dimensional array of ink chambers.

Drop on demand ink jet printing apparatus, particularly inkjet printheads, typically comprise a chamber supplied with droplet fluid and communicating with a nozzle for ejection of droplets therefrom, and means actuable by electrical signals to vary the volume of the chamber, the volume variation being sufficient to effect droplet ejection.

However, with such arrangements there remains problems associated with providing a high density two dimensional array of ink chambers operable at high frequency and with low manufacturing costs.

The present invention seeks to solve these and other problems.

Accordingly, it is an object of at least the preferred embodiments of the present invention to provide ink jet printing apparatus that is capable of both high performance and efficiency coupled with a simple manufacturing method and low cost that can be manufactured into a two dimensional array.

It is another such object to allow simpler methods of electrical interconnect and a wider choice of electrical interconnect methods within a shear mode drop on demand ink jet printing apparatus.

It is another such object to allow a configuration of a roof mode shear disc actuator that does not suffer from the constraints of cross talk between neighbouring actuators.

It is another such object to allow for the capability of a large matrix shear mode array to be manufactured from a number of smaller matrices.

In a first aspect, the present invention provides drop-on-demand ink jet printing apparatus, comprising a nozzle on a nozzle axis; an ink chamber extending radially about the nozzle axis; ink supply means communicating with the ink chamber and an actuator movable in the direction of the nozzle axis to effect, through acoustic wave travel in the ink chamber radially of the nozzle axis, ejection of an ink drop through the nozzle and replenishment of the ink chamber with ink.

In one preferred embodiment, the ink chamber extends a radial distance R from the nozzle axis, the actuator being movable in the direction of the nozzle between first and second configurations in a time which is at least half of the time R/c, where c is the speed of sound through ink in the ink chamber. For example, with the ink chamber extending a radial distance of 0.5 mm and with the speed of sound through ink in the ink chamber being 500 m/s, the nozzle is moveable between configurations in a time which is at most 500 ns. Preferably, the nozzle is moveable between configurations in a time which is at least an order of magnitude less than the time R/c, more preferably of an order of nanoseconds.

In a preferred embodiment, the actuator comprises a piezoelectric actuating disc associated with the ink chamber and moveable to or from a domed configuration to effect ink drop ejection, the apparatus further comprising electrodes for applying an actuating electric field to the piezoelectric disc.

Preferably, the piezoelectric disc is homogeneous and so poled in relation to the actuating electric field as to move in shear mode. If so, the electric field may be applied in the direction of the nozzle axis, the piezoelectric disc being poled radially.

The piezoelectric disc may be poled in directions which all converge towards the nozzle axis.

The electrodes may comprise a ground electrode on a face of the piezoelectric disc abutting the ink chamber and another electrode on an opposing face of the piezoelectric disc.

The disc may be provided with a projecting member projecting along the nozzle axis, or with a recess substantially concentric with the nozzle.

The ink supply means may serve to supply ink to the ink chamber in a direction radially of the nozzle axis.

The ink supply means may serve to supply ink to the ink chamber at a plurality of locations disposed circumferentially about the ink chamber, preferably serving to supply ink to the ink chamber around substantially the entire periphery of the ink chamber.

The ink chamber may be bounded by a generally circular structure providing a change in acoustic impedance serving to reflect acoustic waves travelling in the ink chamber radially of the nozzle axis. This change in acoustic impedance may be effected through a change in ink depth in the direction of the nozzle axis. The structure may define an annulus of ink about the ink chamber which in the direction of the nozzle axis is of a depth different from the depth of the ink chamber. This annulus may form part of the ink supply means.

Preferably, the apparatus comprises a plurality of said nozzles, each having a respective nozzle axis, said nozzles being provided in parallel and in a two dimensional planar array; a plurality of said ink chambers, each extending about a respective nozzle axis; and a homogeneous piezoelectric sheet having a two dimensional array of said actuators, each actuator being associated with a respective ink chamber.

With such an arrangement, the apparatus may comprise a plurality of said electrodes, one common ground electrode on a face of the piezoelectric sheet abutting the ink chambers and on an opposing face, individual electrodes associated respectively with the ink chambers. The individual electrodes may be connected to electrical pulse applying means through respective electrical connections provided on an interconnection plate laminated with the nozzle plate and the piezoelectric sheet.

The nozzles may be formed in a nozzle plate, said nozzle plate being laminated with the piezoelectric sheet to provide said plurality of ink chambers.

The ink supply means may comprise an array of ink channels formed in said piezoelectric sheet, and ink transfer means for transferring ink from the ink channels to the ink chambers. The ink transfer means may comprise an array of recesses formed in an intermediate plate laminated with the nozzle plate and the piezoelectric sheet.

The nozzle plate, interconnection plate and intermediate plate may each comprise a piezoelectric sheet. Alternatively, the nozzle plate, interconnection plate and intermediate plate may each comprise a sheet of material thermally compatible with the piezoelectric sheet.

In a second aspect, the present invention provides drop-on-demand ink jet printing apparatus comprising a nozzle; an ink chamber communicating with the nozzle; a piezoelectric actuating disc associated with the ink chamber and movable to or from a generally domed configuration to effect droplet ejection through the nozzle; and electrodes for applying an actuating electric field to the piezoelectric disc, wherein the piezoelectric disc is homogeneous and so poled in relation to the actuating electric field as to move in shear mode.

The apparatus may further comprise ink supply means communicating with the ink chamber for replenishment of the ink chamber with ink following droplet ejection.

Preferably, the ink chamber extends radially about the axis of the nozzle, and the disc is moveable to effect, through acoustic wave travel in the ink chamber radially of the axis of the nozzle, droplet deposition through the nozzle.

In a third aspect, the present invention provides drop-on-demand ink jet printing apparatus comprising a two dimensional planar array of parallel nozzles each having a nozzle axis; a plurality of disc-shaped ink chambers each extending about a respective nozzle axis and communicating with the respective nozzle; a homogeneous piezoelectric sheet having a two dimensional array of circularly symmetric actuating regions associated respectively with the ink chambers; and electrodes on the piezoelectric sheet enabling selective actuation of each region thereby to eject a droplet from the associated nozzle.

In a fourth aspect, the present invention provides a method of ink jet printing comprising the steps of establishing a planar body of ink in communication with a nozzle having a nozzle axis, the body of ink extending radially of the nozzle axis; providing in the body of ink an impedance boundary extending circumferentially of the nozzle axis; and selectively moving an actuator in the direction of the nozzle axis so as to establish an acoustic wave travelling radially of the nozzle axis in the ink chamber and reflected by the impedance boundary, thereby to effect ejection of an ink droplet through the nozzle.

The method may further comprise the step of replenishing the body of ink following ink droplet ejection by supplying ink thereto in a direction radial of the nozzle axis.

In a fifth embodiment, the present invention provides a method of manufacturing drop-on-demand ink jet printing apparatus, comprising the steps of forming a nozzle plate having a two dimensional planar array of parallel nozzles each having a nozzle axis; forming a homogeneous piezoelectric sheet having a two dimensional array of circularly symmetric actuating regions associated respectively with the nozzles; applying electrodes on the piezoelectric sheet enabling selective actuation of each region; and laminating the nozzle plate and the piezoelectric sheet, the laminated structure providing a plurality of disc-shaped ink chambers each extending about a respective nozzle axis and communicating with the respective nozzle, such that in the manufactured apparatus, actuation of a selected region of the piezoelectric sheet effects drop ejection from the associated nozzle.

The plurality of ink chambers may be provided by a two dimensional array of circularly symmetric recesses formed in said piezoelectric sheet, each actuating region comprising at least part of the bottom wall of a respective circularly symmetric recess.

The circularly symmetric recesses may be formed by removal of material from the piezoelectric sheet, or during moulding of the piezoelectric sheet.

Polarised actuating regions may be formed by the steps of forming a resist layer on each side of said piezoelectric sheet, exposing the outer side walls and the central portion of the inner bottom wall of each circularly symmetric recess, developing said resist layers, forming a metallic layer on each side of piezoelectric sheet to cover the exposed regions of each circularly symmetric recess, and applying an electric field across said metallic layers.

Electrodes may be formed by the steps of subsequently removing said developed resist layers and said metallic layers, forming resist layers on respective faces of each polarised actuating region, developing said resist layers, forming an electrically insulating layer on both sides of the piezoelectric sheet, removing said resist layers to expose both faces of each polarised actuating region, and depositing said electrodes on both faces of each polarised actuating regions for effecting deflection of the actuating regions in shear mode in the direction of the electric field applied by the electrodes.

Electrical connections to individual electrodes may be formed on an interconnection plate mounted on said piezoelectric sheet. Holes may be formed in the interconnection plate, electrical connections passing through the holes for connection to respective individual electrodes.

An array of ink channels may be formed in the piezoelectric sheet for supplying ink to the ink chambers. The array of ink channels may be formed in the same side of the piezoelectric sheet as the array of circularly symmetric recesses, ink transfer means being provided for transferring ink from the ink channels to the ink chambers.

Preferred features of the present invention will now be described, by way of example, with reference to the accompanying drawings, in which.

Figure 9:
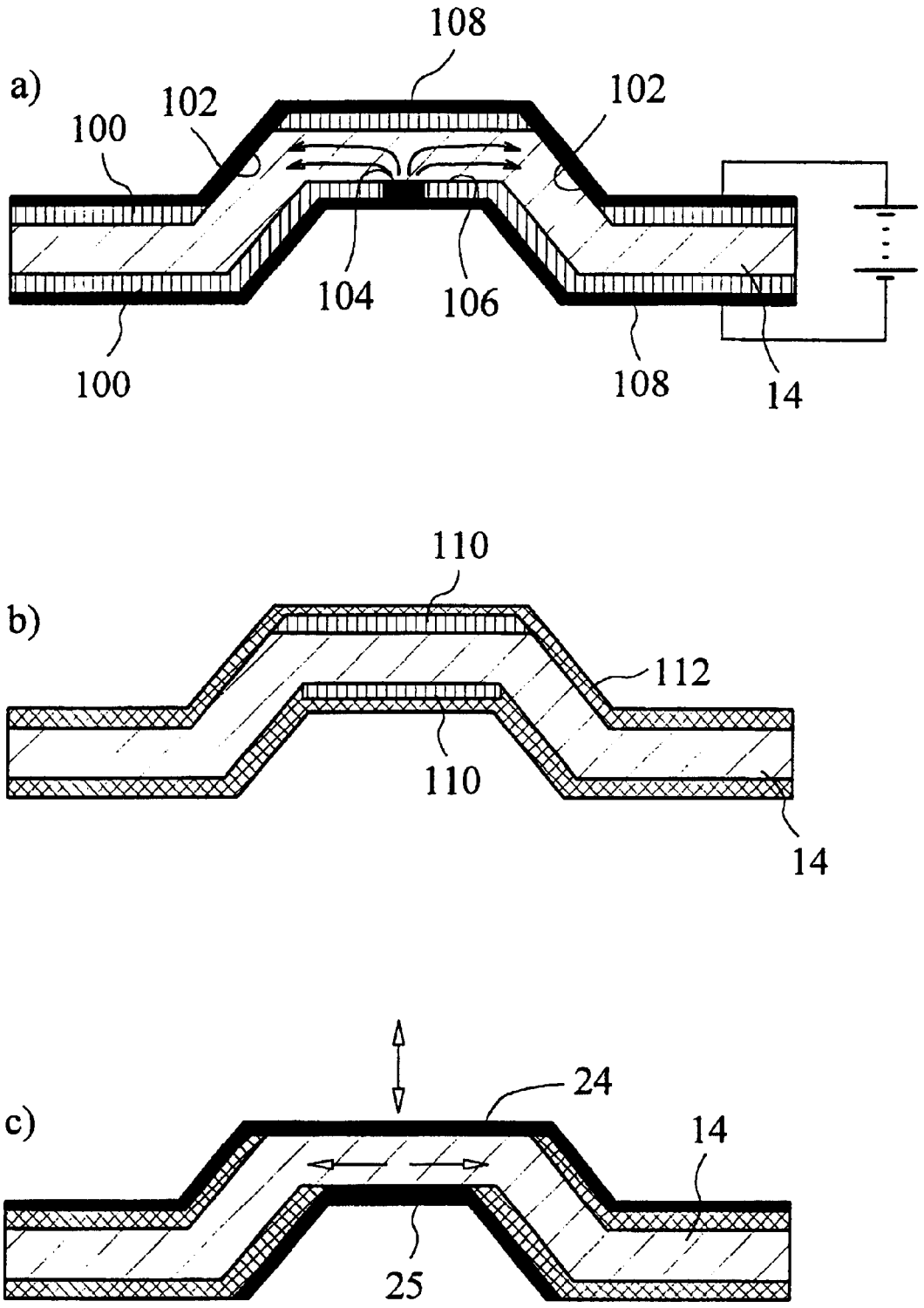
Figure 10:
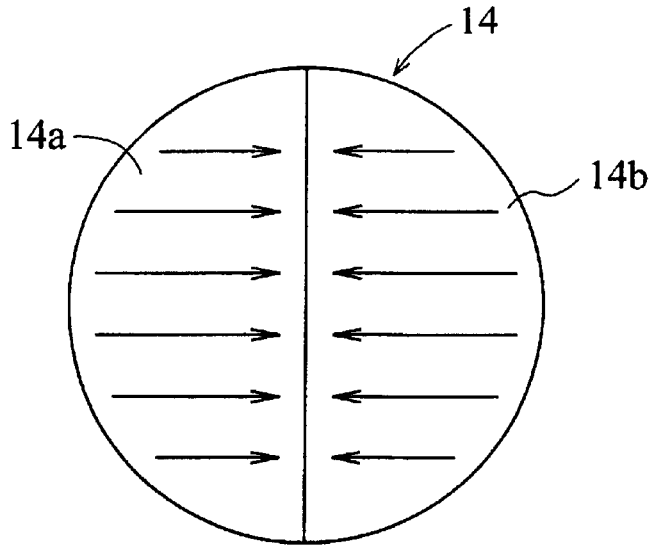
Figure 11:
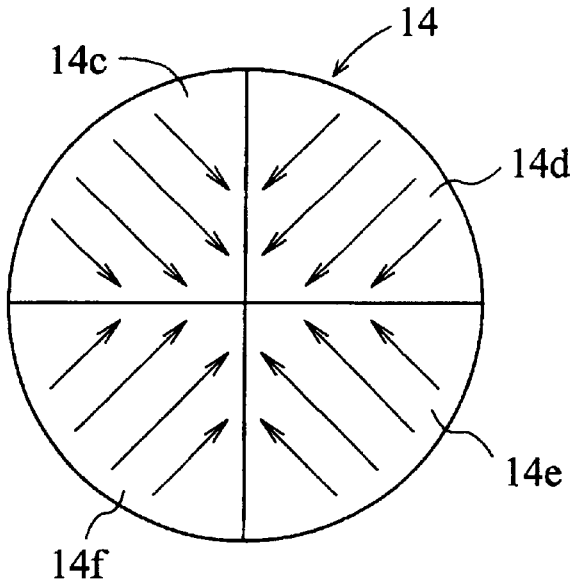

FIGS. 9(*a*) to 9(*c*) illustrate steps in the manufacture of a single actuator; and FIGS. 10 and 11 are top views of alternative poling arrangements for a piezoelectric disc.

FIGS. 1 to 8 illustrate one embodiment of a drop on demand ink jet printing apparatus. The apparatus comprises a laminated structure, formed from a plurality of layers, and which includes an array of ink chambers 22. The droplet ejecting force for each ink chamber is provided by a piezoelectric sheet 14 having actuating regions 10 poled in a radial direction which, in operation, deflect in a direction substantially towards a respective nozzle 19.

Figure 1:
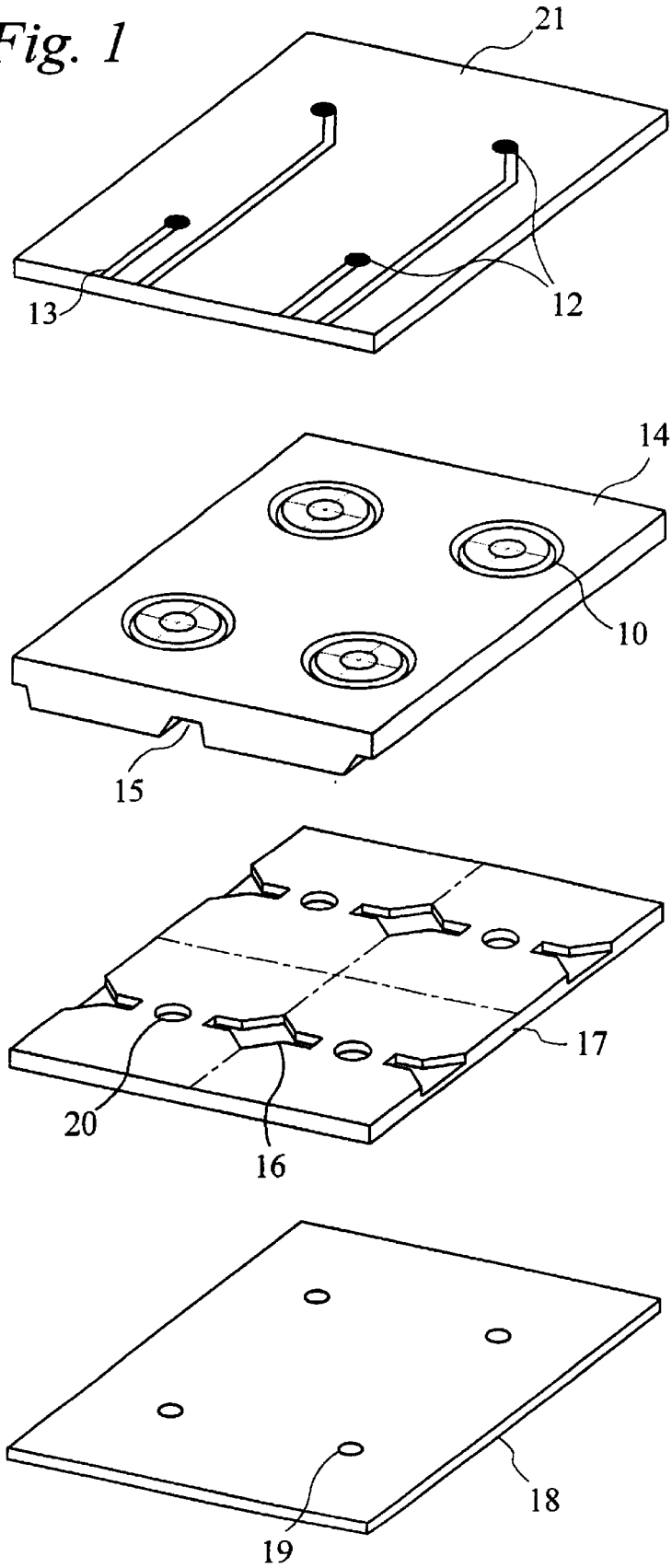
FIG. 1 is a simplified exploded perspective top view of an embodiment of a drop on demand ink jet printing apparatus with a plurality of circular shear disc actuators.

FIG. 1 shows a simplified exploded perspective top view of a number of distinct ink chambers 22 arranged in a 2 by 2 matrix. The apparatus is formed from four layers, which may comprise the same material or thermally compatible materials.

The interconnect layer 21 has holes 12 formed therein through which electrical connection tracks 13 to a drive circuit are passed.

The piezoelectric sheet 14 is machined or moulded so as to form a plurality of recesses for defining the ink chambers 22, actuating regions 10 being formed in respective bottom walls thereof. The actuating regions 10 are designed so as to allow the piezoelectric sheet 14 to deflect towards nozzle plate 18 without causing cross talk between neighbouring actuating regions. Ink channels 15 for allowing ink to flow from a reservoir (not shown) to the ink chambers 22 are formed in the same side of the piezoelectric sheet 14 as the recesses.

Figure 2:
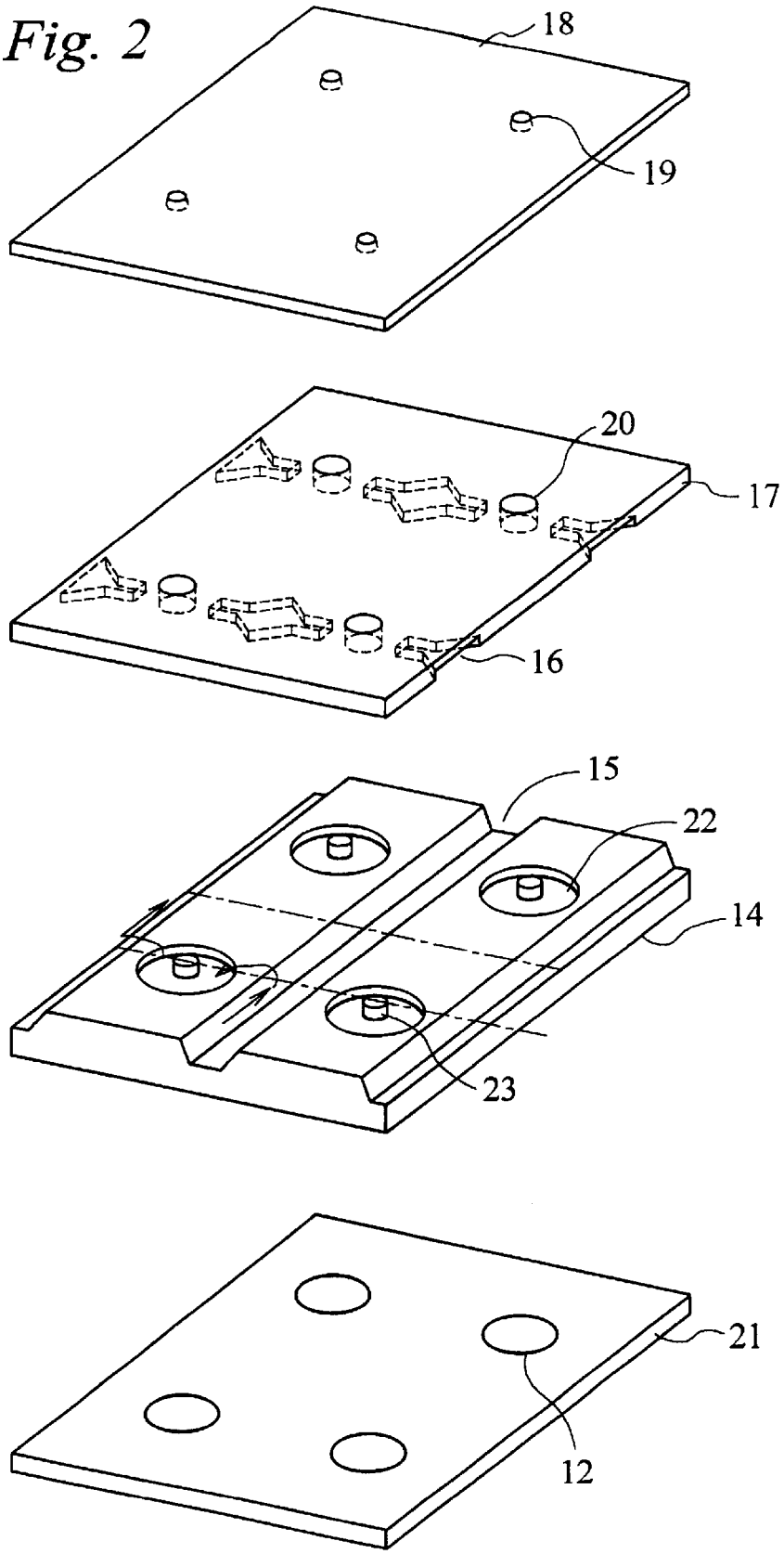
FIG. 2 is a simplified exploded perspective bottom view of the apparatus shown in FIG. 1.

Cut away segments 16 in interposer plate 17 allow ink to flow from the channels 15 into the ink chambers, as shown by means of the arrows in FIG. 2. The arrows show ink being circulated from one channel 15, through the chamber 22 and into the adjacent channel. This prevents stagnation and reduces the build up of air within the apparatus. Alternatively the ink can be fed simultaneously from both sides of the actuating region simultaneously.

The nozzle plate 18 is fixed to the interposer plate 17, and nozzles 19 are provided such that they are situated within the diameter of the orifices 20 of the interposer plate 17.

The exploded perspective bottom view of the arrangement is shown in FIG. 2. This figure shows more clearly the ink channels 15 and the ink chambers 22 formed in the piezoelectric sheet 14.

Each ink chamber 22 may be formed with a central projection or depression situated within the ink chamber. The projection is shown as being cylindrical, however it will be appreciated that it can also be hemispherical, triangular or any other suitable shape. Although the projection as shown is smaller than the orifice 20 in interposer plate 17 it is, of course, possible that a projection of the same size or larger than the orifice 20 can be suitable provided that the projection is free to move below or within the orifice 20. The projection or depression 23 in the ink chamber 22 helps to increase the efficiency of the actuator and improve the control of the drop size and velocity. Additionally, the projection or depression provides a site for applying an electric field during the radial poling of the actuating regions of the piezoelectric sheet 14 during assembly or manufacture.

Electrodes are formed by sputtering or any other suitable method on both the top surface of the ink chamber 22 and the bottom of the piezoelectric sheet 14. When an electric field is applied between opposing electrodes, an associated actuating region of the piezoelectric sheet that has been poled in a radial direction deflects towards the orifice 20 and ejects ink from the nozzle 19.

Figure 3:
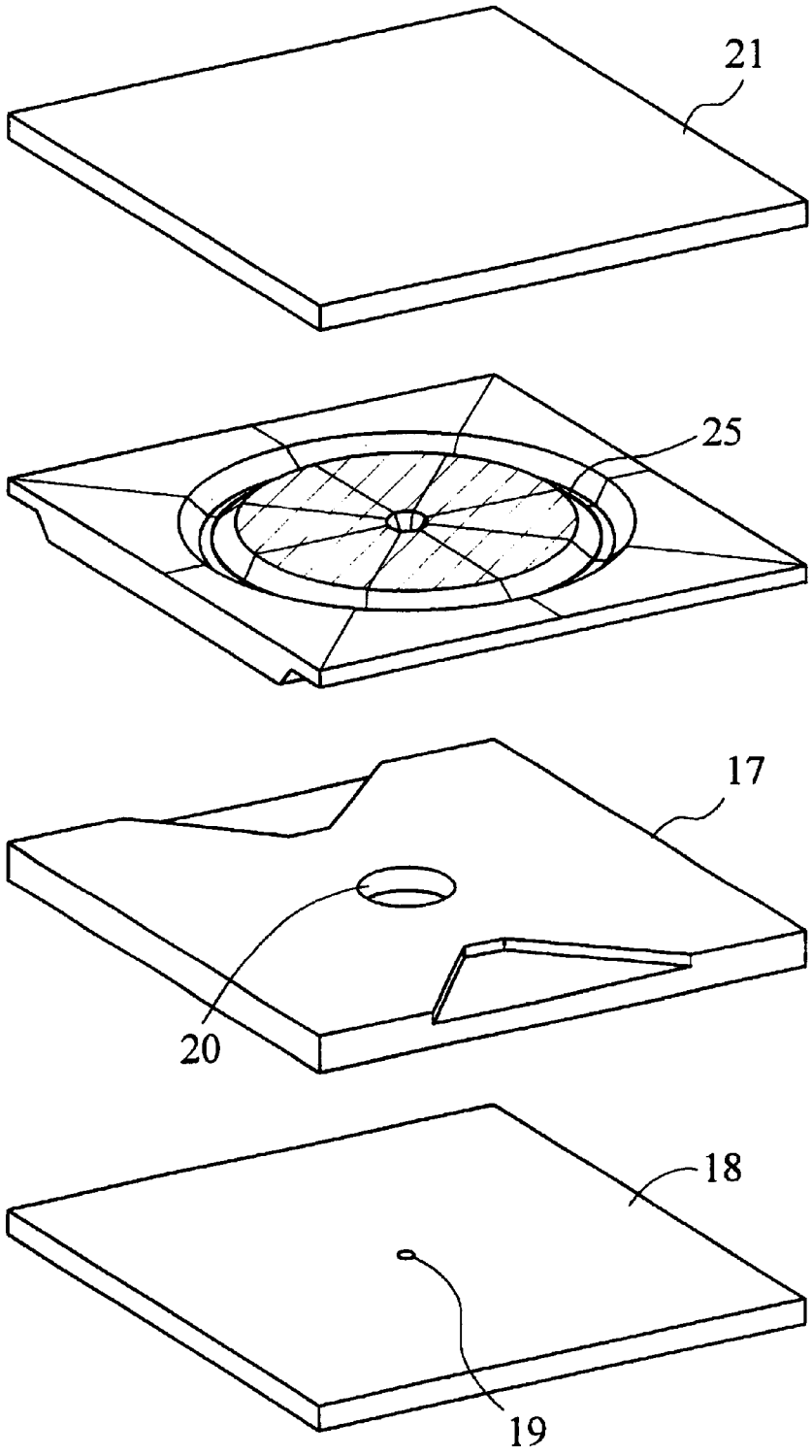
FIGS. 3 and 4 are more detailed exploded perspective views of a single actuator shown in FIG. 1.
Figure 4:
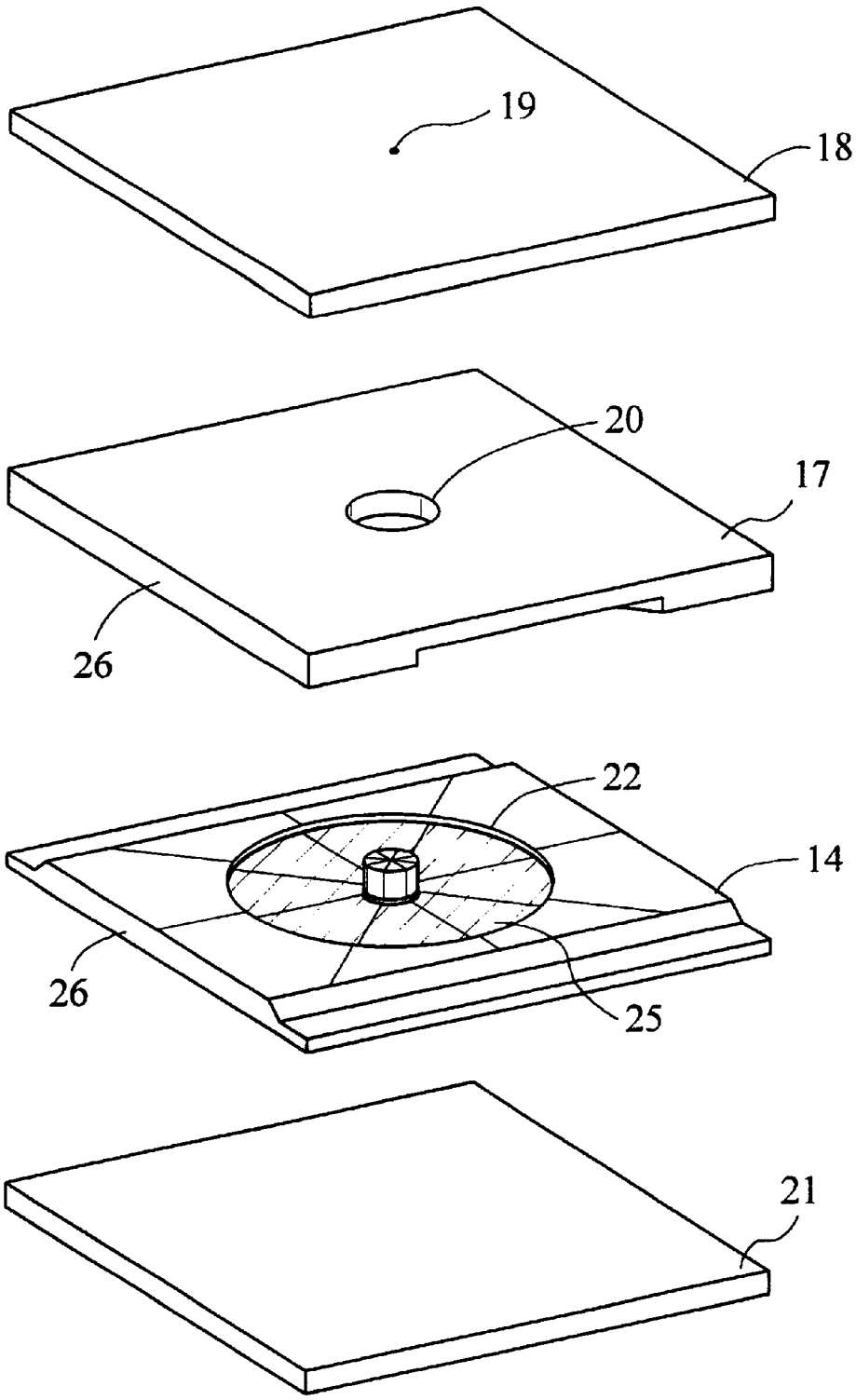

FIGS. 3 and 4 illustrate in more detail a single actuating region and ink chamber (details of the interconnect layer 21 having been omitted). The simple arrangement of four separate layers allows for easy manufacture using modern moulding methods as well as conventional machining. One advantage of manufacture by moulding is that bumps or grooves can be formed on one or more of the plates and sheet with respective hollows or protrusions on the opposite face. This allows for simple but accurate alignment of the respective layers. It is also be possible to locate protrusions on the edge surfaces 26 to allow a modular build up of individual or groups of transducers into a larger array of matrices.

The fact that only the ground electrode 25 is in contact with the ink means that the passivation required when printing water based inks is reduced and in some cases obviated entirely as no current flows from the electrode into the ink, the piezoelectric sheet 14 acting as an insulation barrier. The piezoelectric sheet can be joined to the interposer plate 17 and the interconnect plate 21 by means of a conductive adhesive or any other convenient method. In addition the nozzles can be formed in situ as well as ex situ depending on the preferred manufacturing method.

Figure 6:
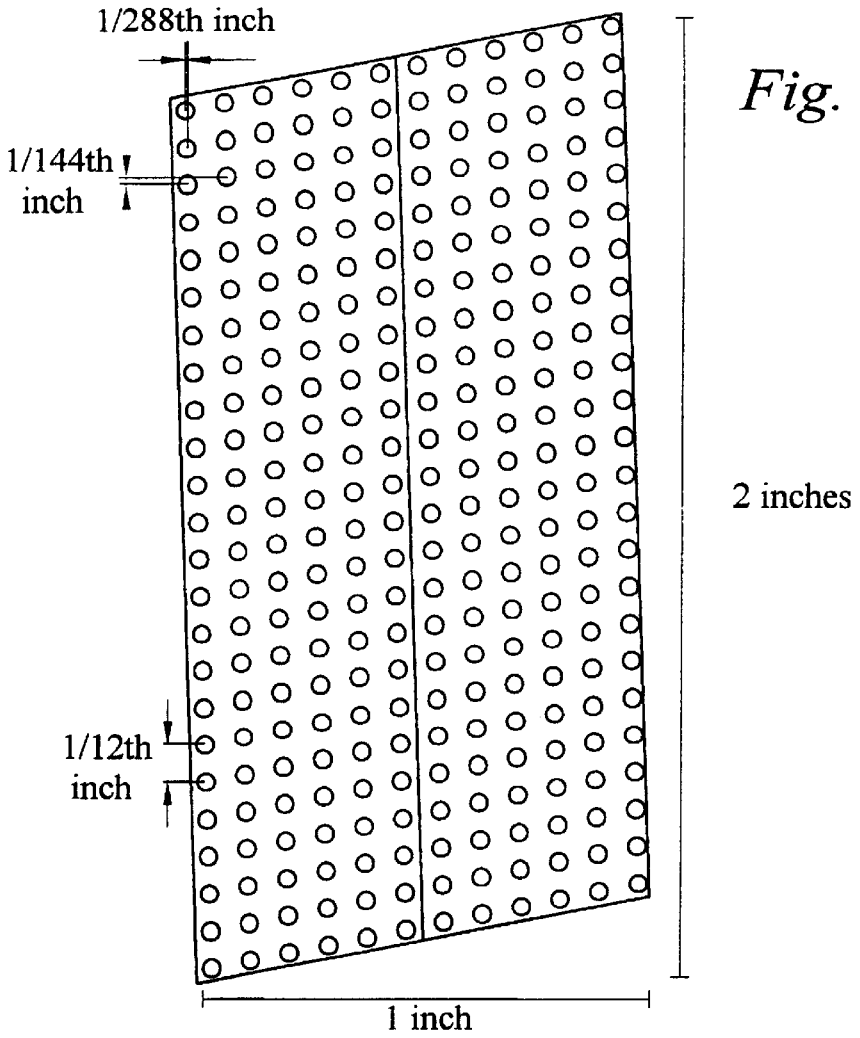
FIGS. 5 and 6 are top views of matrix arrangements, showing a 144 by 144 dpi arrangement and a 288 by 72 dpi arrangement respectively.
Figure 5:
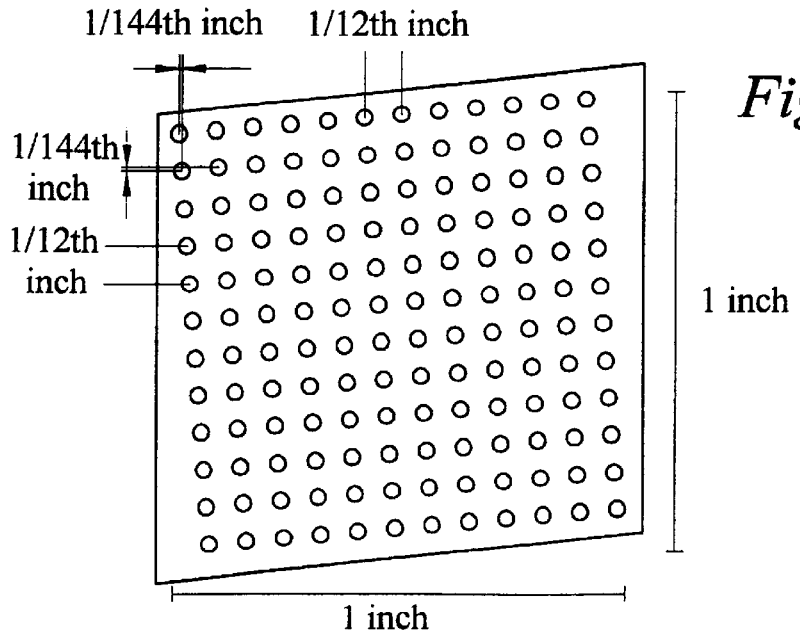

Although FIGS. 1 and 2 show a 2 by 2 matrix a full array assembly would typically consist of a 16 by 16 nozzle array measuring approximately 18 by 18 mm. This gives rise to a dot density of the order 360 dpi. The print density can be varied easily in the matrix arrangement simply by specifying a different print density. For example FIG. 5 shows the actuator positions in a 12 by 12 matrix. The matrix has total dimensions of 1 inch by 1 inch and each nozzle is separated from the adjacent nozzle by 1/12th of an inch. A dot density of 144 dpi in both dimensions is formed by indexing the nozzles in both the horizontal and vertical rows by 1/144th of an inch. FIG. 6 depicts the actuator positions in a 24 by 12 matrix which gives rise to a drop density of 288 dpi in the horizontal direction and 72 dpi in the vertical direction. The array is formed from two 24 by 6 modules butted side by side. It is, of course, possible to butt a number of the distinct modules together to form as large an array as required even up to page width. As can be noted the interconnect density does not change significantly depending on the matrix configuration. The same effect of forming the matrix could, of course, be achieved by forming a square or rectangular array and angling the entire head.

Figure 7:
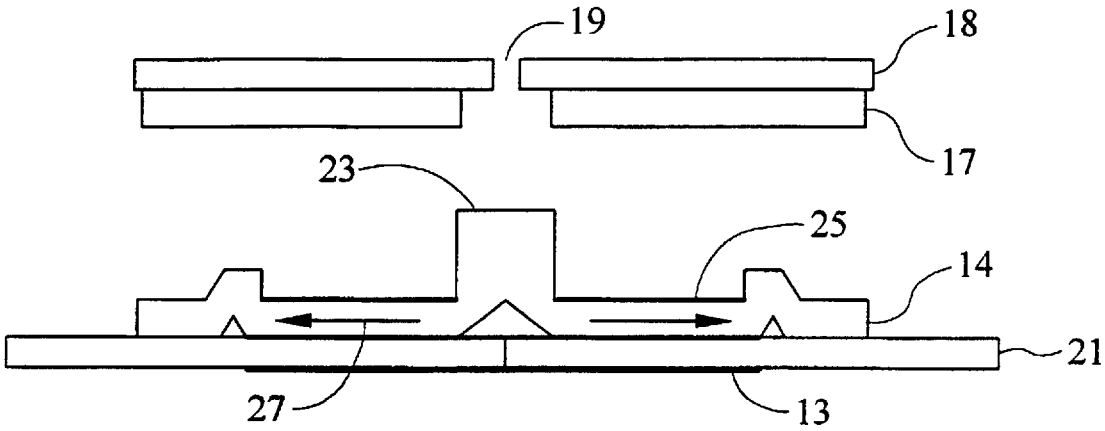
FIG. 7 is a side view of the single actuator shown in FIG. 3.
Figure 8:
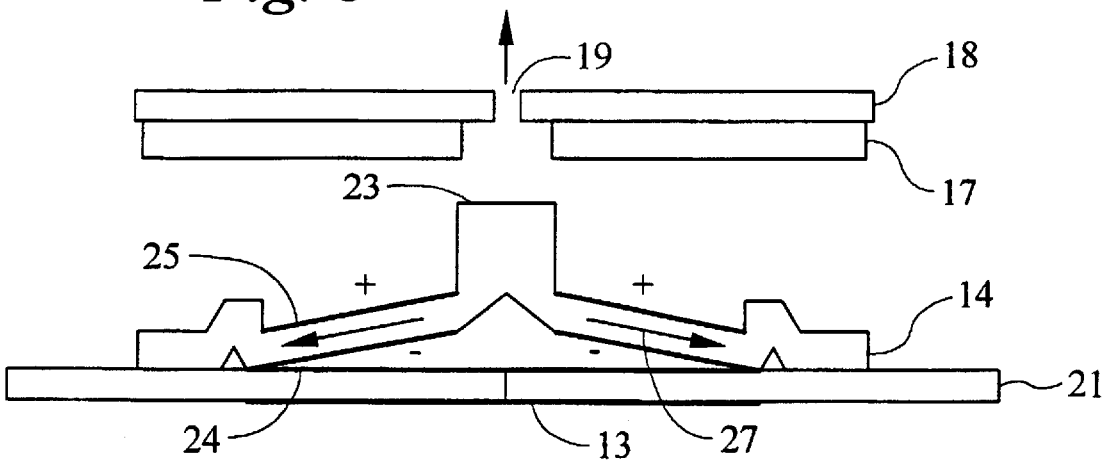
FIG. 8 is a side view of the actuator shown in FIG. 3 in an actuated state.

FIGS. 7 and 8 are exploded sectional views of the single ink chamber shown in FIG. 3. Ink is fed into the ink chamber from either one or both of the sides thereof. The actuating region is in the form of a disc of the piezoelectric sheet which is poled radially in the direction of the arrow 27. FIG. 8 shows the deflection of the piezoelectric disc as a potential difference is applied across the electrodes 24,25 positioned thereon. As the central projection 23 moves towards the nozzle 19 a droplet is ejected. Once the electric field is removed the piezoelectric disc returns to its original position shown in FIG. 7.

The actuator is capable of emitting ink droplets responsively to applying differential voltage pulses to the electrodes 24, 25. Each such pulse sets up an electric field in the direction normal to the direction of polarisation 27. This develops shear distortion in the piezoelectric disc 14 and causes the disc to deflect in the direction of the electric field, as shown in FIG. 8. This displacement establishes a pressure in the ink chamber. Typically, a pressure of 30–300 kPa is applied to operate the ink chamber and this can be obtained with only a small mean deflection since the chamber dimension normal to the plate 14 is small.

Dissipation of the pressure developed in this way in the ink, provided that the pressure exceeds a minimum value, causes a droplet of ink to be expelled from the nozzle 19. This occurs by reason of an acoustic pressure wave which travels radially within the chamber, is reflected from the side walls of the chamber to dissipate the energy stored in the ink and actuator, and converges again in the centre of the chamber to effect ejection of ink from the chamber. The volume strain or condensation as the pressure wave recedes from the nozzle develops a flow of ink from the nozzle outlet aperture for a period R/c, where c is the effective acoustic velocity of ink in the chamber and R is the radial distance to the walls of the chamber. A droplet of ink is expelled during this period. After time R/c the pressure becomes negative, ink emission ceases and the applied voltage can be removed. Subsequently, as the pressure wave is damped, ink ejected from the chamber is replenished from the ink channel and the droplet expulsion cycle can be repeated. By the application of a number of pulses in quick succession it is possible to increase the size of the droplet ejected and hence build up a number of grey levels.

Various methods may be used to alter the drop ejection characteristics from the ink chamber 22. One such method is to alter the shape and structure of the ink chamber, for example, by increasing the radius of the ink chamber or altering the profile of the orifice 20. The shape of the orifice 20, nozzle 19 and the stiffness of the nozzle plate 18 affect the inertia of ink to be ejected from the chamber. In addition, variations in the thickness of the piezoelectric disc can give rise to variations in the shear deflection of the disc and alter the drop ejection characteristics.

FIG. 9 illustrates an embodiment of a method of forming a radially poled piezoelectric disc in a piezoelectric sheet and subsequently depositing electrodes thereon.

In this embodiment, a resist layer 100 is formed, for example, by sputtering, on each side of the piezoelectric sheet. The portions of the resist layers formed on the outer side walls 102 and the central portion 104 of the inner bottom wall 106 of each recess are removed by, for example, a grinding, ablation or etching technique, and the remaining portions of the resist layers 100 developed. A metallic layer 108 is deposited on each side of the piezoelectric sheet to cover the exposed regions of each recess. As shown in FIG. 9(*a*), an electric field is applied across the metallic layers to pole radially the actuating regions of the recess so that a poled piezoelectric disc is formed with the directions of polarisation converging towards the centre of the disc.

The developed resist layers 100 and the metallic layers 108 are removed and second resist layers 110 formed on respective faces of the poled piezoelectric disc, for example, by deposition and subsequent selective removal of the second resist layers 110.

The remaining portions of the second resist layers 110 are developed, and an electrically insulating layer 112 subsequently formed on both sides of the piezoelectric sheet, as shown in FIG. 9(*b*).

The resist layers are subsequently removed to expose both faces of the poled piezoelectric disc, and electrodes 24, 25 deposited on respective sides of the piezoelectric sheet, as shown in FIG. 9(*c*). Electrode 25 forms the common ground electrode for all of the poled piezoelectric discs, and voltages can be selectively applied to individual portions of the electrode layer 24 to activate poled piezoelectric discs as desired.

Whilst in the aforementioned embodiment the piezoelectric discs are poled radially, that is, poled in directions that all converge towards the nozzle axis, alternative poling arrangements of the piezoelectric discs may also enable radial pressure waves to be generated in the ink chambers by shear mode deflection of the discs upon actuation.

FIGS. 10 and 11 illustrate two such alternative poling arrangements. FIG. 10 shows a plan view of piezoelectric disc 14 formed from two identical halves 14*a*, 14*b*, each half being poled towards the diameter of the disc 14. In the poling arrangement shown in FIG. 11, the piezoelectric disc is formed from four identical quarters 14*c* . . . 14*f*.

In the aforementioned embodiments, the actuating regions are formed by poled piezoelectric discs. However, alternative shapes for the actuating regions are readily envisaged. For example, the actuating region may take any polygonal shape, for example, triangular, rectangular or hexagonal, with segments of the actuating region being suitably poled for deflection in shear mode upon actuation to develop radial acoustic wave travel in the ink chamber.

All of the aforementioned embodiments provide a droplet on demand inkjet apparatus utilising a piezoelectric actuator arranged so as to deflect in shear mode. In summary, the apparatus is formed of a plurality of laminated plates arranged so as to define an ink chamber 22. The actuator forms one side of the chamber and deflects towards a nozzle 19 formed in a nozzle plate 18 which provides the opposite side of the chamber. An interconnect layer 21 acts as the substrate and has orifices 12 to allow the tracks 13 to the driver chip to pass through. On the opposite side of the interconnect layer is the piezoelectric sheet 14. Electrodes 24,25 are provided between the interconnect layer and the piezoelectric sheet. The piezoelectric sheet is carved, drilled or moulded so as to provide parallel ink channels 15 and a circular depression with a raised central reservation 23. The piezoelectric sheet is bonded to the interposer plate or ground electrode which in turn is bonded to the nozzle plate. When a charge is applied between the two electrodes, a selected actuator 10 of the piezoelectric sheet 14 deflects in shear mode towards the nozzle plate. This movement provides sufficient energy to eject a droplet from the nozzle. A number of short pulses could be applied so as to increase the size of the droplet ejected. A number of distinct pressure chambers 22 connected only by the parallel ink channels are arranged in a two dimensional matrix which allows for increased distances between the actuators 10 allowing for less densely packed electrical connections than are required in a linear array.

What is claimed is:

1. Drop-on-demand ink jet printing apparatus, comprising a nozzle on a nozzle axis; an ink chamber extending radially about the nozzle axis, wherein the ink chamber is bounded by a generally circular structure providing a change in acoustic impedance serving to reflect acoustic waves traveling in the ink chamber radially of the nozzle axis; ink supply means communicating with the ink chamber; and an actuator movable in the direction of the nozzle axis to effect, through acoustic wave travel in the ink chamber radially of the nozzle axis, ejection of an ink drop through the nozzle and replenishment of the ink chamber with ink.

2. Apparatus according to claim 1, wherein the ink chamber extends a radial distance R from the nozzle axis and wherein the actuator is movable in the direction of the nozzle between first and second configurations in a time which is at least an order of magnitude less than the time R/c, where c is the speed of sound through ink in the ink chamber.

3. Apparatus according to claim 1 or 2, wherein the actuator comprises a piezoelectric actuating disc associated with the ink chamber and moveable to or from a domed configuration to effect ink drop ejection, the apparatus further comprising electrodes for applying an actuating electric field to the piezoelectric disc.

4. Apparatus according to claim 3, wherein the piezoelectric disc is homogeneous and so poled in relation to the actuating electric field as to move in shear mode.

5. Apparatus according to claim 4, wherein the electric field is applied in the direction of the nozzle axis, the piezoelectric disc being poled radially.

6. Apparatus according to claim 5, wherein the piezoelectric disc is poled in directions which all converge towards the nozzle axis.

7. Apparatus according to claim 5 or 6, wherein the electrodes comprise a ground electrode on a face of the piezoelectric disc abutting the ink chamber and another electrode on an opposing face of the piezoelectric disc.

8. Apparatus according to any of claims 3 to 7, wherein said disc is provided with a projecting member projecting along said nozzle axis.

9. Apparatus according to any of claims 3 to 7, wherein said disc is provided with a recess substantially concentric with the nozzle.

10. Apparatus according to any preceding claim, wherein the ink supply means serves to supply ink to the ink chamber in a direction radially of the nozzle axis.

11. Apparatus according to any preceding claim, wherein the ink supply means serves to supply ink to the ink chamber at a plurality of locations disposed circumferentially about the ink chamber.

12. Apparatus according to claim 11, wherein the ink supply means serves to supply ink to the ink chamber around substantially the entire periphery of the ink chamber.

13. Apparatus according to claim 1, wherein said change in acoustic impedance is effected through a change in ink depth in the direction of the nozzle axis.

14. Apparatus according to claim 1 or 13, wherein said structure defines an annulus of ink about the ink chamber which in the direction of the nozzle axis is of a depth different from the depth of the ink chamber.

15. Apparatus according to claim 14, wherein said annulus forms part of the ink supply means.

16. Apparatus according to any preceding claim, comprising a plurality of said nozzles, each having a respective nozzle axis, said nozzles being provided in parallel and in a two dimensional planar array; a plurality of said ink chambers, each extending about a respective nozzle axis; and a homogeneous piezoelectric sheet having a two dimensional array of said actuators, each actuator being associated with a respective ink chamber.

17. Apparatus according to claim 16 when dependent from any of claims 3 to 7, comprising a plurality of said electrodes, one common ground electrode on a face of the piezoelectric sheet abutting the ink chambers and on an opposing face, individual electrodes associated respectively with the ink chambers.

18. Apparatus according to claim 17, wherein the individual electrodes are connected to electrical pulse applying means through respective electrical connections provided on an interconnection plate laminated with the nozzle plate and the piezoelectric sheet.

19. Apparatus according to any of claims 16 to 18, wherein said nozzles are formed in a nozzle plate, said nozzle plate being laminated with the piezoelectric sheet to provide said plurality of ink chambers.

20. Apparatus according to claim 19, wherein ink supply means comprises an array of ink channels formed in said piezoelectric sheet, and ink transfer means for transferring ink from the ink channels to the ink chambers.

21. Apparatus according to claim 20, wherein the ink transfer means comprise an array of recesses formed in an intermediate plate laminated with the nozzle plate and the piezoelectric sheet.

22. Apparatus according to claim 21 when dependent from claim 18, wherein said nozzle plate, said interconnection plate and said intermediate plate each comprise a piezoelectric sheet.

23. Apparatus according to claim 21 when dependent from claim 18, wherein said nozzle plate, said interconnection plate and said intermediate plate each comprise a sheet of material thermally compatible with said piezoelectric sheet.

24. Drop-on-demand ink jet printing apparatus comprising a nozzle; an ink chamber communicating with the nozzle, wherein the ink chamber extends radially about an axis of the nozzle; a piezoelectric actuating disc associated with the ink chamber and movable to or from a generally domed configuration to effect droplet ejection through the nozzle; and electrodes for applying an actuating electric field to the piezoelectric disc, wherein the piezoelectric disc is homogeneous and so poled in relation to the actuating electric field as to move in shear mode, and wherein the disc is moveable to effect, through acoustic wave travel in the ink chamber radially of the axis of the nozzle, droplet deposition through the nozzle.

25. Apparatus according to claim 24, wherein the piezoelectric disc is of radius R' and is movable to and from said domed configuration in a time which is at least an order of magnitude less than the time R'/c, where c is the speed of sound through ink in the ink chamber.

26. Apparatus according to claim 24 or 25, further comprising ink supply means communicating with the ink chamber for replenishment of the ink chamber with ink following droplet ejection.

27. Apparatus according to claim 26, wherein the ink supply means serves to supply ink to the ink chamber in a direction radially of the direction of the axis of the nozzle.

28. Apparatus according to claim 26 or 27, wherein the ink supply means serves to supply ink to the ink chamber at a plurality of locations disposed circumferentially about the ink chamber.

29. Apparatus according to claim 27, wherein the ink supply means serves to supply ink to the ink chamber around substantially the entire periphery of the ink chamber.

30. Apparatus according to any of claims 24 to 29, wherein said electric field is applied in the direction of the axis of the piezoelectric disc and wherein the piezoelectric disc is poled radially.

31. Apparatus according to claim 30, wherein the piezoelectric disc is poled in directions which all converge towards the centre of the piezoelectric disc.

32. Apparatus according to claim 30 or 31, wherein the ink chamber extends radially about the axis of the nozzle, and the disc is moveable to effect, through acoustic wave travel in the ink chamber radially of the axis of the nozzle, droplet deposition through the nozzle.

33. Apparatus according to claim 32, wherein said change in acoustic impedance is effected through a change in ink depth in the direction of the nozzle axis.

34. Apparatus according to claim 32 or 33, wherein said structure defines an annulus of ink about the ink chamber which in the direction of the nozzle axis is of a depth different from the depth of the ink chamber.

35. Apparatus according to claim 34 when dependent from claim 26, wherein said annulus forms part of the ink supply means.

36. Apparatus according to any of claims 24 to 35, wherein the electrodes comprise a ground electrode on a face of the piezoelectric disc abutting the ink chamber and another electrode on an opposing face of the piezoelectric disc.

37. Apparatus according to any of claims 24 to 36, wherein each disc is provided with a projecting member projecting along said nozzle axis.

38. Apparatus according to any of claims 24 to 36, wherein each disc is provided with a recess substantially concentric with the nozzle.

39. Apparatus according to any of claims 24 to 38, comprising a plurality of said nozzles, each having a respective nozzle axis, said nozzles being provided in parallel and in a two dimensional planar array; a plurality of said ink chambers, each extending about a respective nozzle axis; and a homogeneous piezoelectric sheet having a two dimensional array of said actuators, each actuator being associated with a respective ink chamber.

40. Apparatus according to claim 39, comprising one common ground electrode on a face of the piezoelectric sheet abutting the ink chambers and on an opposing face, individual electrodes associated respectively with the ink chambers.

41. Drop-on-demand ink jet printing apparatus comprising a two dimensional planar array of parallel nozzles each having a nozzle axis; a plurality of disc-shaped ink chambers each extending about a respective nozzle axis and communicating with the respective nozzle, wherein each ink chamber is bounded by a generally circular structure providing a change in acoustic impedance serving to reflect acoustic waves traveling in the ink chamber radially of the respective nozzle axis; a homogeneous piezoelectric sheet having a two dimensional array of circularly symmetric actuating regions associated respectively with the ink chambers; and electrodes on the piezoelectric sheet enabling selective actuation of each region thereby to eject a droplet from the associated nozzle.

42. Apparatus according to claim 41, wherein each ink chamber extends a radial distance R" from the respective nozzle axis and wherein each actuating region is movable in the direction of the respective nozzle between first and second configurations in a time which is at least an order of magnitude less than the time R"/c, where c is the speed of sound through ink in each ink chamber.

43. Apparatus according to claim 41 or 42, wherein each actuating region is provided with a projecting member projecting in the direction of the respective nozzle axis.

44. Apparatus according to claim 41 or 42, wherein each actuating region is provided with a recess substantially concentric with the respective nozzle.

45. Apparatus according to any of claims 41 to 44, further comprising ink supply means communicating with each ink chamber for replenishment of ink chambers with ink following droplet ejection therefrom.

46. Apparatus according to claim 45, wherein the ink supply means serves to supply ink to each ink chamber in a direction radially of the direction of the axis of the respective nozzle.

47. Apparatus according to claim 45 or 46, wherein the ink supply means serves to supply ink to each ink chamber at a plurality of locations disposed circumferentially about that ink chamber.

48. Apparatus according to claim 47, wherein the ink supply means serves to supply ink to each ink chamber around substantially the entire periphery of that ink chamber.

49. Apparatus according to any of claims 41 to 48, wherein each actuating region is moveable to or from a domed configuration to effect ink drop ejection, said electrodes being arranged to apply selectively an actuating electric field to each actuating region.

50. Apparatus according to claim 49, wherein each actuating region is so poled in relation to the actuating electric field as to move in shear mode.

51. Apparatus according to claim 50, wherein the actuating electric field is applied in the direction of the respective nozzle axis, each actuating region being poled radially.

52. Apparatus according to claim 51, wherein each actuating region is poled in directions which all converge towards the respective nozzle axis.

53. Apparatus according to claim 51 or 52, wherein each ink chamber extends radially about the axis of the respective nozzle, and each actuating region is moveable to effect, through acoustic wave travel in the respective ink chamber radially of the axis of the respective nozzle, droplet deposition through the respective nozzle.

54. Apparatus according to claim 53, wherein said change in acoustic impedance is effected through a change in ink depth in the direction of the nozzle axis.

55. Apparatus according to claim 53 or 54, wherein said structure defines an annulus of ink about each ink chamber which in the direction of the respective nozzle axis is of a depth different from the depth of the ink chamber.

56. Apparatus according to claim 55 when dependent from claim 45, wherein each annulus forms part of the ink supply means.

57. Apparatus according to any of claims 41 to 56, wherein said electrodes comprise a common, ground electrode on a face of the piezoelectric sheet abutting the ink chambers and on an opposing face, individual electrodes associated respectively with the ink chambers.

58. Apparatus according to claim 40 or 57, wherein the individual electrodes are connected to electrical pulse applying means through respective electrical connections provided on an interconnection plate laminated with the nozzle plate and the piezoelectric sheet.

59. Apparatus according to any of claims 40 to 58, wherein said nozzles are formed in a nozzle plate, said nozzle plate being laminated with the piezoelectric sheet to provide said plurality of ink chambers.

60. Apparatus according to claim 59, wherein ink supply means comprises an array of ink channels formed in said piezoelectric sheet, and ink transfer means for transferring ink from the ink channels to the ink chambers.

61. Apparatus according to claim 60, wherein the ink transfer means comprise an array of recesses formed in an intermediate plate laminated with the nozzle plate and the piezoelectric sheet.

62. Apparatus according to claim 61 when dependent from claim 58, wherein said nozzle plate, said intermediate plate and said interconnection plate each comprise a piezoelectric sheet.

63. Apparatus according to claim 61 when dependent from claim 58, wherein said nozzle plate, said intermediate plate and said interconnection plate each comprise a sheet of material thermally compatible with said piezoelectric sheet.

64. A method of ink jet printing comprising the steps of establishing a planar body of ink in communication with a nozzle having a nozzle axis, the body of ink extending radially of the nozzle axis; providing in the body of ink a generally circular structure defining an ink chamber bounded by the generally circular structure, the generally circular structure providing a change in acoustic impedance extending circumferentially of the nozzle axis; and selectively moving an actuator in the direction of the nozzle axis so as to establish an acoustic wave traveling radially of the nozzle axis in the ink chamber and reflected by the change in acoustic impedance of the generally circular structure, thereby to effect ejection of an ink droplet through the nozzle.

65. A method according to claim 64, wherein the body of ink extends a radial distance R from the nozzle axis, the actuator being moved in the direction of the nozzle between first and second configurations in a time which is at least an order of magnitude less than the time R/c, where c is the speed of sound through ink in the ink chamber.

66. A method according to claim 64 or 65, wherein the actuator comprises a piezoelectric actuating disc associated with the body of ink, the actuator being moved to or from a domed configuration to effect ink drop ejection, electrodes being provided for applying an actuating electric field to the piezoelectric disc.

67. A method according to claim 66, wherein the piezoelectric disc is homogeneous and so poled in relation to the actuating electric field as to move in shear mode.

68. A method according to claim 67, wherein the electric field is applied in the direction of the nozzle axis, the piezoelectric disc being poled radially.

69. A method according to claim 68, wherein the piezoelectric disc is poled in directions which all converge towards the nozzle axis.

70. A method according to claim 68 or 69, wherein the electrodes comprise a ground electrode on a face of the piezoelectric disc abutting the body of ink and another electrode on an opposing face of the piezoelectric disc.

71. A method according to any of claims 64 to 70, further comprising the step of replenishing the body of ink following ink droplet ejection by supplying ink thereto in a direction radial of the nozzle axis.

72. A method according to claim 71, wherein the ink is supplied at a plurality of locations disposed circumferentially about the body of ink.

73. A method according to claim 72, wherein the ink is supplied around substantially the entire periphery of the body of ink.

74. A method according to any of claims 64 to 73, wherein the impedance boundary is provided by changing the ink depth in the body of ink in the direction of the nozzle axis.

75. A method of manufacturing drop-on-demand ink jet printing apparatus, comprising the steps of forming a nozzle plate having a two dimensional planar array of parallel nozzles each having a nozzle axis; forming a homogeneous piezoelectric sheet having a two dimensional array of circularly symmetric actuating regions associated respectively with the nozzles; applying electrodes on the piezoelectric sheet enabling selective actuation of each region; and laminating the nozzle plate and the piezoelectric sheet, the laminated structure providing a plurality of disc-shaped ink chambers each extending about a respective nozzle axis and communicating with the respective nozzle, wherein each ink chamber is bounded by a generally circular structure which, in the manufactured apparatus, provides a change in acoustic impedance serving to reflect acoustic waves traveling in the ink chamber radially of the respective nozzle axis, such that in the manufactured apparatus, actuation of a selected region of the piezoelectric sheet effects drop ejection from the associated nozzle.

76. A method according to claim 75, wherein each ink chamber extends a radial distance R" from the respective nozzle axis and wherein each actuating region is movable in the direction of the respective nozzle between first and second configurations in a time which is at least an order of magnitude less than the time R"/c, where c is the speed of sound through ink in each ink chamber.

77. A method according to claim 75 or 76, wherein each actuating region is moveable to or from a domed configuration to effect ink drop ejection, said electrodes being applied on the piezoelectric sheet so as to apply selectively an actuating electric field to each actuating region.

78. A method according to claim 77, wherein each actuating region is so poled in relation to the actuating electric field as to move in shear mode.

79. A method according to claim 78, each actuating region being poled radially.

80. A method according to claim 79, each actuating region being poled in directions that all converge towards the respective nozzle axis.

81. A method according to claim 79 or 80, wherein said plurality of ink chambers are provided by a two dimensional array of circularly symmetric recesses formed in said piezoelectric sheet, each actuating region comprising at least part of the bottom wall of a respective circularly symmetric recess.

82. A method according to claim 81, characterised by forming the circularly symmetric recesses by removal of material from the piezoelectric sheet.

83. A method according to claim 81, characterised by forming the circularly symmetric recesses during moulding of the piezoelectric sheet.

84. A method according to any of claims 78 to 83, wherein the polarised actuating regions are formed by the steps of forming a resist layer on each side of said piezoelectric sheet, exposing the outer side walls and the central portion of the inner bottom wall of each circularly symmetric recess, developing said resist layers, forming a metallic layer on each side of piezoelectric sheet to cover the exposed regions of each circularly symmetric recess, and applying an electric field across said metallic layers.

85. A method according to claim 84, wherein said electrodes are formed by the steps of subsequently removing said developed resist layers and said metallic layers, forming resist layers on respective faces of each polarised actuating region, developing said resist layers, forming an electrically insulating layer on both sides of the piezoelectric sheet, removing said resist layers to expose both faces of each polarised actuating region, and depositing said electrodes on both faces of each polarised actuating regions for effecting deflection of the actuating regions in shear mode in the direction of the electric field applied by the electrodes.

86. A method according to any of claims 75 to 85, wherein electrical connections to said individual electrodes are formed on an interconnection plate mounted on said piezoelectric sheet.

87. A method according to claim 86, characterised in that said nozzle plate and said interconnection plate are formed from piezoelectric material.

88. A method according to claim 86, characterised in that said nozzle plate and said interconnection plate are formed from material thermally compatible with said piezoelectric sheet.

89. A method according to any of claims 86 to 88, characterised in that holes are formed in said interconnection plate, said electrical connections passing through said holes for connection to respective individual electrodes.

90. A method according to any of claims 75 to 89, characterised by forming an array of ink channels in said piezoelectric sheet for supplying ink to the ink chambers.

91. A method according to claim 90 when dependent from claim 81, characterised by forming said array of ink channels in the same side of the piezoelectric sheet as the array of circularly symmetric recesses, and providing ink transfer means for transferring ink from the ink channels to the ink chambers.

92. A method according to claim 91, characterised by providing said ink supply means by forming an array of ink supply recesses in an intermediate plate, said intermediate plate being mounted on said piezoelectric sheet so that each ink supply recesses overlaps an ink channel and a circularly symmetric recess.

93. A method according to claim 92, wherein said change in acoustic impedance is effected through a change in ink depth in the direction of the nozzle axis.

94. A method according to claim 92 or 93, wherein said structure defines an annulus of ink about each ink chamber which in the direction of the respective nozzle axis is of a depth different from the depth of the ink chamber.

95. A method according to any of claims 75 to 94, wherein each actuating region is formed with a projecting member projecting in the direction of the respective nozzle axis.

96. A method according to any of claims 75 to 95, wherein each actuating region is formed with a recess substantially concentric with the respective nozzle.

* * * * *

UNITED STATES PATENT AND TRADEMARK OFFICE

CERTIFICATE OF CORRECTION

PATENT NO. : 6,422,690 B1
DATED : July 23, 2002
INVENTOR(S) : Harvey et al.

It is certified that error appears in the above-identified patent and that said Letters Patent is hereby corrected as shown below:

Column 8,
Line 33, please delete "or 2".
Line 48, please delete "or 6".
Lines 52 and 55, please delete "any of claims 3 to 7" and substitute -- claim 3 -- therefor.
Lines 58 and 61, please delete "any preceding claim" and substitute -- claim 1 -- therefor.

Column 9,
Line 4, please delete "or 13".
Line 10, please delete "any preceding claim" and substitute -- claim 1 -- therefor.
Line 18, please delete "when dependent from any of claims 3 to 7, comprising a plurality of said electrodes]" and insert

--wherein the actuator comprises a piezoelectric actuating disc associated with the ink chamber and movable to or from a domed configuration to effect ink drop ejection, the apparatus further comprising a plurality of electrodes for applying an actuating electric field to the piezoelectric disc--.

Line 29, please delete "any of claims 16 to 18" and substitute -- claim 16 -- therefor.
Line 41, please delete "when dependent from claim 18" and insert -- wherein the actuator comprises a piezoelectric actuating disc associated with the ink chamber and movable to or from a domed configuration to effect ink drop ejection, the apparatus further comprising a plurality of electrodes for applying an actuating electric field to the piezoelectric disc, one common ground electrode on a face of the piezoelectric sheet abutting the ink chambers and on an opposing face, individual electrodes associated respectively with the ink chambers wherein the individual electrodes are connected to electrical pulse applying means through respective electrical connections provided on an interconnection plate laminated with the nozzle plate and the piezoelectric sheet,--.

Line 45, please delete "when dependent from claim 18" and insert -- wherein the actuator comprises a piezoelectric actuating disc associated with the ink chamber and movable to or from a domed configuration to effect ink drop ejection, the apparatus further comprising a plurality of electrodes for applying an actuating electric field to the piezoelectric disc, one common ground electrode on a face of the piezoelectric sheet abutting the ink chambers and on an opposing face, individual electrodes associated respectively with the ink chambers wherein the individual electrodes are connected to electrical pulse applying means through respective electrical connections provided on an interconnection plate laminated with the nozzle plate and the piezoelectric sheet,--.

UNITED STATES PATENT AND TRADEMARK OFFICE

CERTIFICATE OF CORRECTION

PATENT NO. : 6,422,690 B1
DATED : July 23, 2002
INVENTOR(S) : Harvey et al.

It is certified that error appears in the above-identified patent and that said Letters Patent is hereby corrected as shown below:

Column 10,
Line 1, please delete "or 25".
Line 8, please delete "or 27".
Line 15, please delete "any of claims 24 to 29" and substitute -- claim 24 -- therefor.
Line 22, please delete "or 31 ".
Line 30, please delete "or 33".
Line 34, please delete "when dependent from claim 26" and insert -- further comprising ink supply means communicating with the ink chamber for replenishment of the ink chamber with ink following droplet ejection, --.
Line 37, please delete "any of claims 24 to 35" and substitute -- claim 24 -- therefor.
Line 42, please delete "any of claims 24 to 36" and substitute -- claim 24 -- therefor.
Line 45, please delete "any of claims 24 to 36" and substitute -- claim 24 -- therefor.
Line 48, please delete "any of claims 24 to 38" and substitute -- claim 24 -- therefor.

Column 11,
Line 14, please delete "or 42".
Line 17, please delete "or 42".
Line 20, please delete "any of claims 41 to 44" and substitute -- claim 41 -- therefor.
Line 28, please delete "or 46".
Line 36, please delete "any of claims 41 to 48" and substitute -- claim 41 -- therefor.
Line 50, please delete "or 52".
Line 59, please delete "or 54".
Line 63, please delete "when dependent from claim 45" and insert -- further comprising ink supply means communicating with each ink chamber for replenishment of ink chambers with ink following droplet ejection therefrom, --.
Line 66, please delete "any of claims 41 to 56" and substitute -- claim 41 -- therefor.

Column 12,
Line 4, please delete "40 or 57" and substitute -- 41 -- therefor.
Line 9, please delete "any of claims 40 to 58" and substitute -- claim 41-- therefor.
Line 21, please delete "when dependent from claim 58" and insert -- wherein the individual electrodes are connected to electrical pulse applying means through respective electrical connections provided on an interconnection plate laminated with the nozzle plate and the piezoelectric sheet, and --.
Line 25, please delete "when dependent from claim 58" and insert -- wherein the individual electrodes are connected to electrical pulse applying means through respective electrical connections provided on an interconnection plate laminated with the nozzle plate and the piezoelectric sheet, and --.
Line 49, please delete "or 65".
Line 64, please delete "or 69".

UNITED STATES PATENT AND TRADEMARK OFFICE

CERTIFICATE OF CORRECTION

PATENT NO. : 6,422,690 B1
DATED : July 23, 2002
INVENTOR(S) : Harvey et al.

It is certified that error appears in the above-identified patent and that said Letters Patent is hereby corrected as shown below:

Column 13,
Line 1, please delete "any of claims 64 to 70" and substitute -- claim 64 -- therefor.
Line 11, please delete "any of claims 64 to 73" and substitute --claim 64 -- therefor.
Line 40, please delete "or 76".
Line 53, please delete "or 80".

Column 14,
Line 1, please delete many of claims 78 to 83" and substitute -- claim 78 -- therefor.
Line 21, please delete "any of claims 75 to 85" and substitute -- claim 75 -- therefor.
Line 32, please delete "any of claims 86 to 88" and substitute -- claim 86 -- therefor.
Line 36, please delete "any of claims 75 to 89" and substitute -- claim 75 -- therefor.
Line 39, please delete "when dependent from claim 81 ".
Line 40, please delete "said" and substitute -- an -- therefor.
Line 40, after channels insert -- for supplying ink to the ink chamber --.
Line 54, please delete "or 93".
Line 58, please delete "any of claims 75 to 94" and substitute -- claim 75 -- therefor.
Line 61, please delete "any of claims 75 to 95" and substitute -- claim 75 -- therefor.

Signed and Sealed this

Twenty-second Day of April, 2003

JAMES E. ROGAN
*Director of the United States Patent and Trademark Office*